US008418425B1

(12) United States Patent
Santini

(10) Patent No.: US 8,418,425 B1
(45) Date of Patent: Apr. 16, 2013

(54) TUBULAR BEAM FOR THE CONSTRUCTION OF TEMPORARY STRUCTURES

(76) Inventor: Patrick J. Santini, West Bend, WI (US)

( * ) Notice: Subject to any disclaimer, the term of this patent is extended or adjusted under 35 U.S.C. 154(b) by 0 days.

(21) Appl. No.: 13/332,416

(22) Filed: Dec. 21, 2011

Related U.S. Application Data

(60) Provisional application No. 61/427,937, filed on Dec. 29, 2010.

(51) Int. Cl.
*E04H 12/00* (2006.01)

(52) U.S. Cl.
USPC ..... 52/655.1; 52/690; 52/653.1; 52/838

(58) Field of Classification Search ..... 52/690, 52/831, 836, 837, 847, 653.1, 745.19, 633, 52/645, 646, 648.1, 650.1, 653.2, 655.1; 446/85, 105, 106, 118, 120, 122, 124, 125; 256/65.15; 403/217, 231, 300, 162, 192, 403/292
See application file for complete search history.

(56) References Cited

U.S. PATENT DOCUMENTS

| | | | | |
|---|---|---|---|---|
| 1,818,418 | A * | 8/1931 | Millard | 52/263 |
| 4,047,341 | A * | 9/1977 | Bernardi | 52/837 |
| 6,240,687 | B1 * | 6/2001 | Chong | 52/238.1 |
| 6,250,025 | B1 * | 6/2001 | Darby | 52/137 |
| 6,615,562 | B2 * | 9/2003 | Fritsche et al. | 52/696 |
| 7,264,416 | B2 * | 9/2007 | Kahl | 403/187 |
| 7,464,513 | B2 * | 12/2008 | Rioux | 52/651.01 |
| 7,637,076 | B2 * | 12/2009 | Vaughn | 52/838 |
| 7,762,038 | B2 * | 7/2010 | Ceba et al. | 52/653.1 |
| 7,874,120 | B2 * | 1/2011 | Ohata et al. | 52/655.1 |
| 2008/0178551 | A1 * | 7/2008 | Porter | 52/653.1 |

* cited by examiner

*Primary Examiner* — Brian Glessner
*Assistant Examiner* — Beth Stephan
(74) *Attorney, Agent, or Firm* — Donald J. Ersler

(57) ABSTRACT

A tubular beam for construction of temporary structures preferably includes a rectangular tube, a first end plate and a second end plate. A plurality of tube access openings are formed through each side of the rectangular tube. A fastener hole pattern is formed around each tube access opening. The first and second end plates are attached to each end of the rectangular tube. A plate access opening is formed through the first and second end plates. The fastener hole pattern is formed around the plate access opening. Two or more adjacent tubular beams may be assembled to each other in "I," "L," "T" or "double T" configurations by inserting a plurality of threaded fasteners through the fastener holes in each adjacent tubular beam. The plurality of threaded fasteners are secured with a plurality of nuts. A fastening plate may also be used to join two adjacent tubular beams.

10 Claims, 7 Drawing Sheets

TUBULAR BEAM FOR THE CONSTRUCTION OF TEMPORARY STRUCTURES

CROSS-REFERENCES TO RELATED APPLICATIONS

This is a utility patent application taking priority from provisional application No. 61/427,937 filed on Dec. 29, 2010.

BACKGROUND OF THE INVENTION

1. Field of the Invention

The present invention relates generally to tubular beams and more specifically to a tubular beam for the construction of temporary structures, which allows a temporary structure to be efficiently constructed.

2. Discussion of the Prior Art

It appears that the prior art does not disclose a tubular beam for the construction of temporary structures. Conventional scaffolding or pipe and block assemblies are typically used to construct temporary structures.

Accordingly, there is a clearly felt need in the art for a tubular beam for the construction of temporary structures, which allows a temporary structure to be efficiently constructed with fasteners.

SUMMARY OF THE INVENTION

The present invention provides a tubular beam for the construction of temporary structures, which allows a temporary structure to be efficiently constructed with fasteners. The tubular beam for construction of temporary structures (tubular beam) preferably includes a rectangular tube, a first end plate and a second end plate. A plurality of redundant tube access openings are formed through a length of each side of the rectangular tube. A fastener hole pattern is preferably formed concentric with each tube access opening. The first end plate is welded to a first end of the rectangular tube and the second end plate is welded to a second end of the rectangular tube. A plate access opening is formed through the first and second end plates. The fastener hole pattern is preferably formed concentric with the plate access opening. The fastener hole pattern preferably includes four fastener holes.

Two or more adjacent tubular beams may be assembled to each other in "I," "L," "T" or "double T" configurations by locating the fastener hole patterns concentric with each other. A plurality of threaded fasteners are inserted through the fastener holes in each adjacent tubular beam, and a plurality of nuts are threaded and tightened on to the plurality of threaded fasteners. However, other types of suitable fasteners may also be used. A fastening plate may also be used to join two adjacent tubular beams. The fastening plate includes four fastener holes that are located to hold together two or more adjacent tubular beams in a "I," "L," "T" or "double T" assembly configuration. The four fastener holes in the first and second end plates have the same fastener hole pattern as in the rectangular tube. The plurality of threaded fasteners and nuts are used to secure the two or more adjacent tubular beams to each other.

Accordingly, it is an object of the present invention to provide a tubular beam for the construction of temporary structures, which allows a temporary structure to be efficiently constructed with fasteners.

These and additional objects, advantages, features and benefits of the present invention will become apparent from the following specification.

DETAILED DESCRIPTION OF THE PREFERRED EMBODIMENTS

Figure 1:
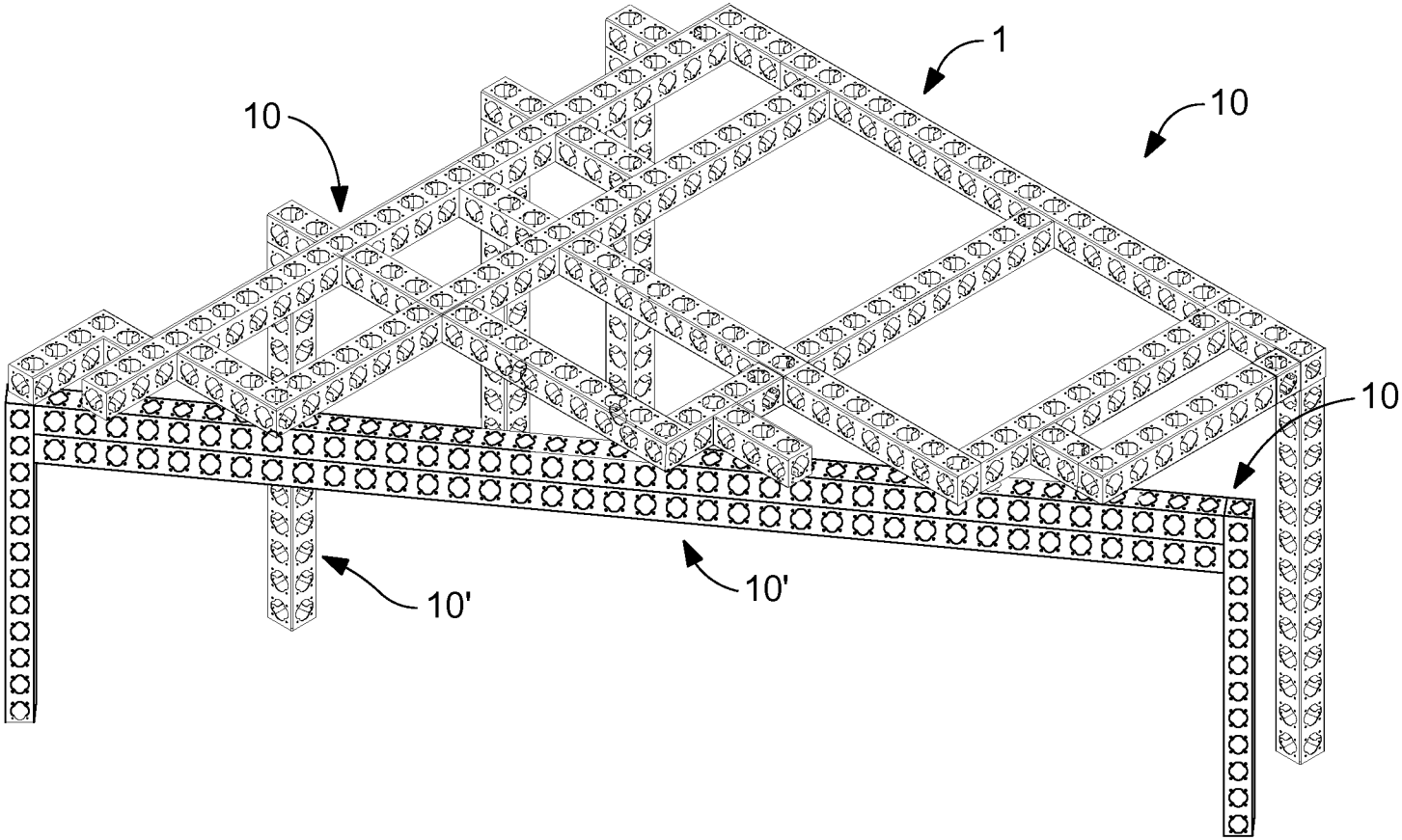
FIG. 1 is a perspective view of a self-supporting temporary stage constructed from a plurality of tubular beams in accordance with the present invention.
Figure 2:
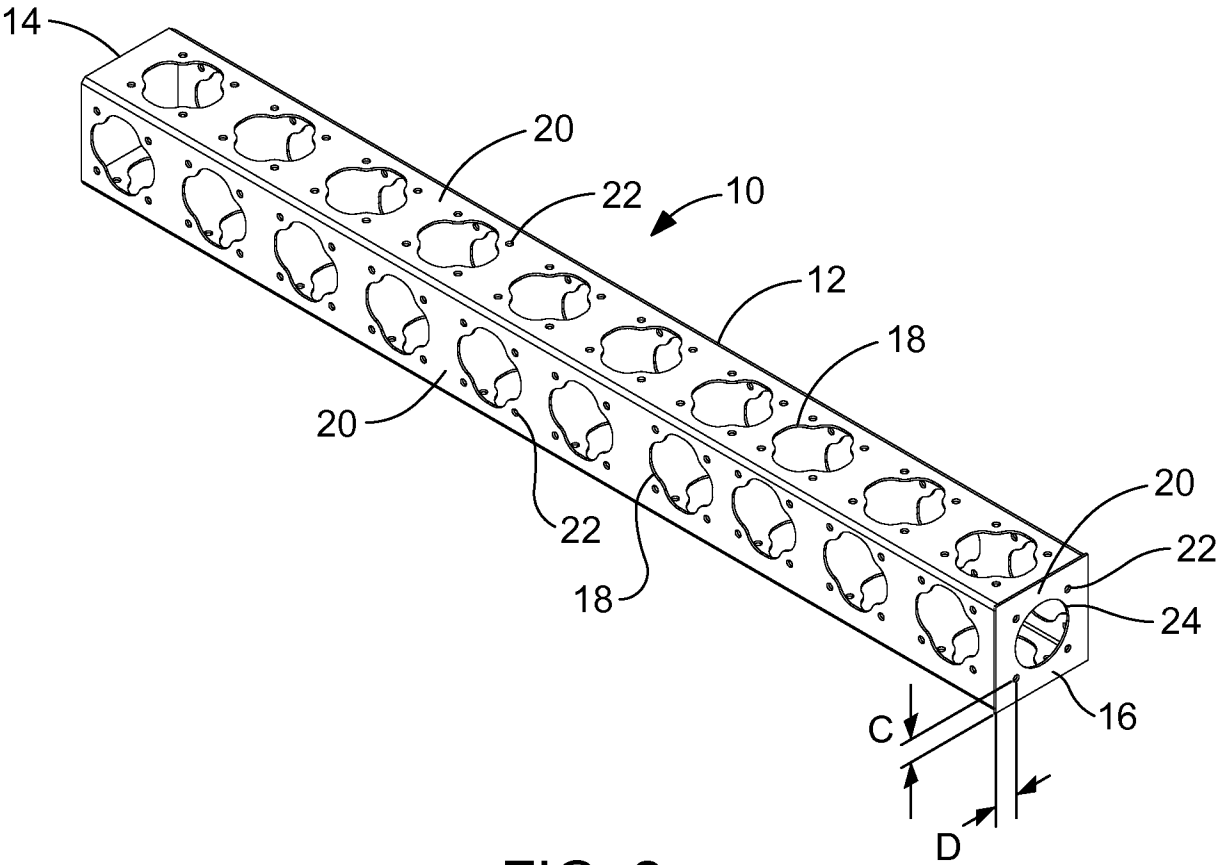
FIG. 2 is a perspective view of a tubular beam in accordance with the present invention.

With reference now to the drawings, and particularly to FIG. 1, there is shown a perspective view of a temporary stage 1 constructed from a plurality of tubular beams 10. With reference to FIG. 2, the tubular beam 10 preferably includes a rectangular tube 12, a first end plate 14 and a second end plate 16. The tubular beam 10 may be fabricated by an extrusion process or fabricated by welding lengthwise edges of four plates to each other to form a tube. The tubular beam 10 may be manufactured to any standard or nonstandard length.

Figure 3:
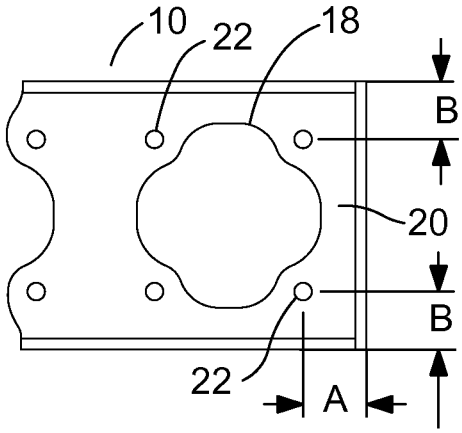
FIG. 3 is an enlarged side view of an end portion of a tubular beam in accordance with the present invention.

With reference to FIG. 3, a plurality of redundant tube access openings 18 are formed through a length of each side of the rectangular tube 12. The shape of the tube access opening 18 should not be limited to that shown in the figures, but should include any suitable shape. A fastener hole pattern 20 includes four fastener holes 22 preferably arraigned in a rectangular pattern. The distance "A" between the two fastener holes 22 and each end of the tubular beam 10 is equal to the distance "B" between the two fastener holes 22 and each side of the tubular beam 10. The fastener hole pattern 20 is preferably formed concentric with each tube opening.

The first end plate 14 is welded to a first end of the rectangular tube 12 and the second end plate 16 is welded to a second end of the rectangular tube 12. A plate access opening 24 is formed through the first and second end plates. The shape of the plate access opening 24 should not be limited to that shown in the figures, but should include any suitable shape. The fastener hole pattern 20 is preferably formed concentric with the plate access opening 24. The distance "C" from the fastener hole 22 to one edge of the second plate 16 is equal to distances "A" and "B." The distance D from the fastener hole 22 to an adjacent edge of the second plate 16 is equal to distances "A" and "B."

Figure 4:
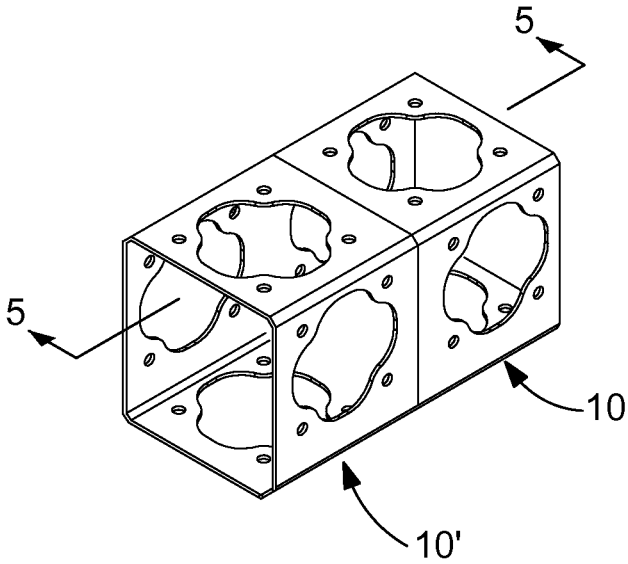
FIG. 4 is a perspective view of two adjacent tubular beams assembled to each other in an "I" configuration in accordance with the present invention.
Figure 5:
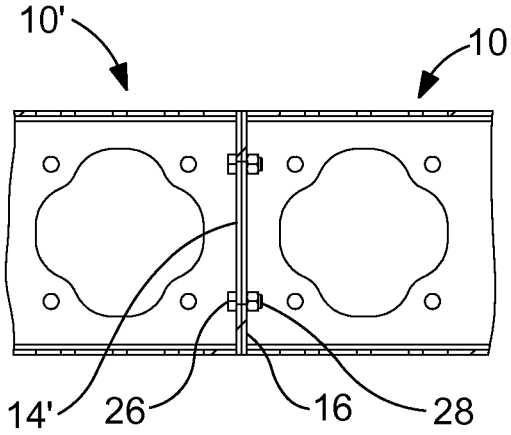
FIG. 5 is a cross sectional view of two adjacent tubular beams assembled to each other in an "I" configuration in accordance with the present invention.

With reference to FIGS. 4-9, the aforementioned location of the fastener holes 22 allow two or more adjacent tubular beams 10 to be assembled to each other in "I," "L," "T" or "double T" configurations by locating the fastener hole patterns 20 concentric with each other. With reference to FIGS. 4-5, the tubular beam 10' is attached to the tubular beam 10 in an "I" configuration by inserting four threaded fasteners 26 through the plurality of fastener holes 20 in the first end plate 14' and the second end plate 16. Four nuts 28 are then threaded and tightened on to the four threaded fasteners 26. It is preferable to use washers with the threaded fasteners 26 and nuts 28. Additionally, other types of suitable fasteners may also be used, besides the threaded fasteners 26, the nuts 28 and the washers. The tube access openings 18 and the plate access openings 24 allow a hand to be inserted into a middle of the rectangular tube 12 to tighten or loosen the plurality of nuts 28.

With reference to FIG. 1, tubular beams 10 are bolted to tubular beams 10' to form a double beam or laminated beam. The tubular beams 10, 10' are also bolted together end to end as shown in FIGS. 4-5. The double beam provides increased rigidity for applications for decreasing the number of vertical tubular beams.

Figure 6:
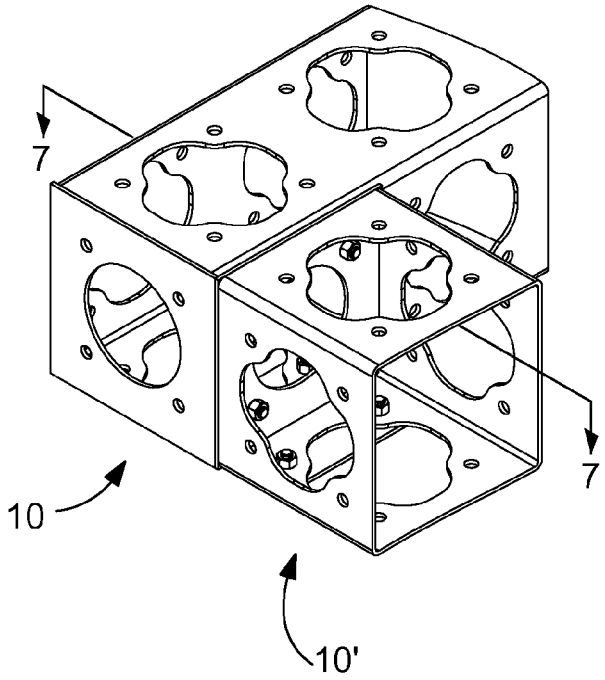
FIG. 6 is a perspective view of two adjacent tubular beams assembled to each other in a "L" configuration in accordance with the present invention.
Figure 7:
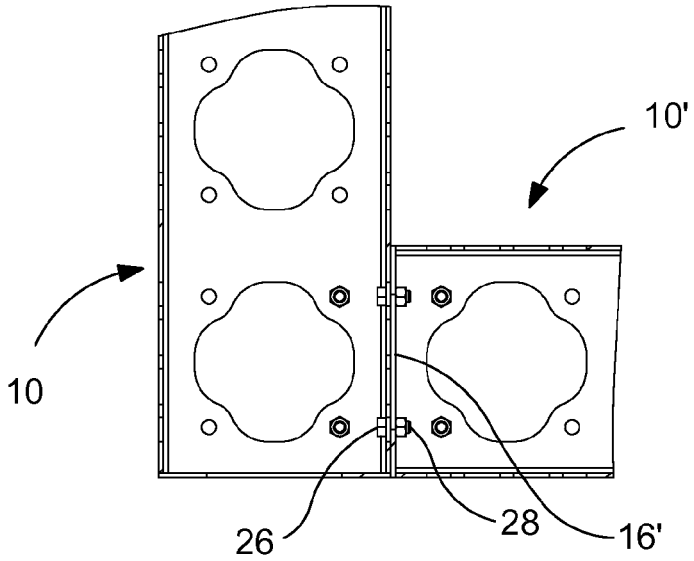
FIG. 7 is a cross sectional view of two adjacent tubular beams assembled to each other in a "L" configuration in accordance with the present invention.
Figure 8:
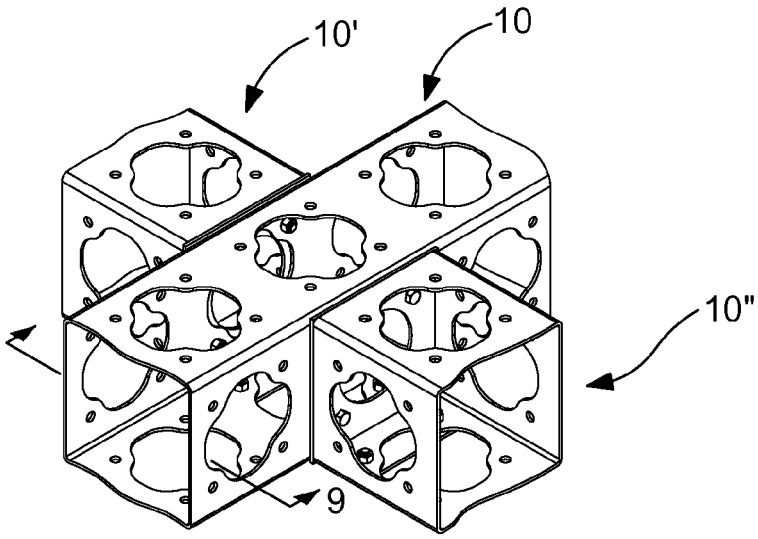
FIG. 8 is a perspective view of three adjacent tubular beams assembled to each other in a "double T" configuration in accordance with the present invention.
Figure 9:
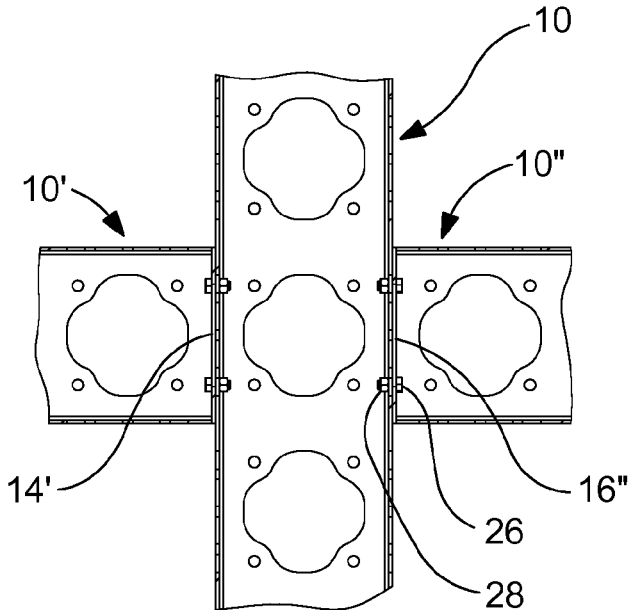
FIG. 9 is a cross sectional view of three adjacent tubular beams assembled to each other in a "double T" configuration in accordance with the present invention.

With reference to FIGS. 6-7, the tubular beam 10' is attached to the tubular beam 10 in a "L" configuration by inserting four threaded fasteners 26 through the plurality of fastener holes 20 in a side of the tubular beam 10 and the second end plate 16'. The four nuts 28 are then threaded and tightened on to the four threaded fasteners 26. With reference to FIGS. 8-9, the tubular beam 10' is attached to the tubular beam 10 and the tubular beam 10" is attached to the tubular beam 10 in line with the tubular beam 10' to form a "double T" configuration. Four threaded fasteners 26 are inserted through the plurality of fastener holes 20 in the first end plate 14' and one side of the tubular beam 10. Four additional threaded fasteners 26 are inserted through the plurality of fastener holes 20 in the second end plate 16" and the opposing side of the tubular beam 10. The eight nuts 28 are then threaded and tightened on to the eight threaded fasteners 26.

Figure 10:
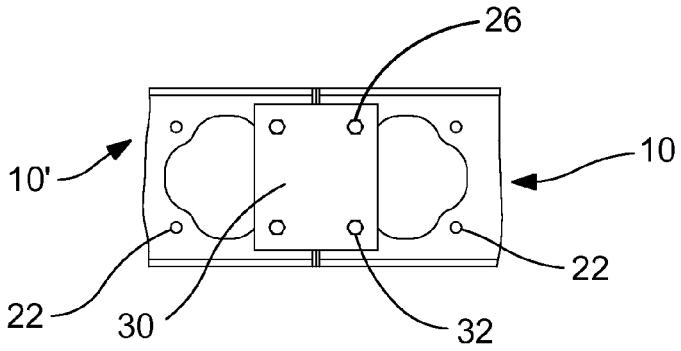
FIG. 10 is a top view of two adjacent tubular beams assembled to each other in an "I" configuration with a fastening plate in accordance with the present invention.
Figure 11:
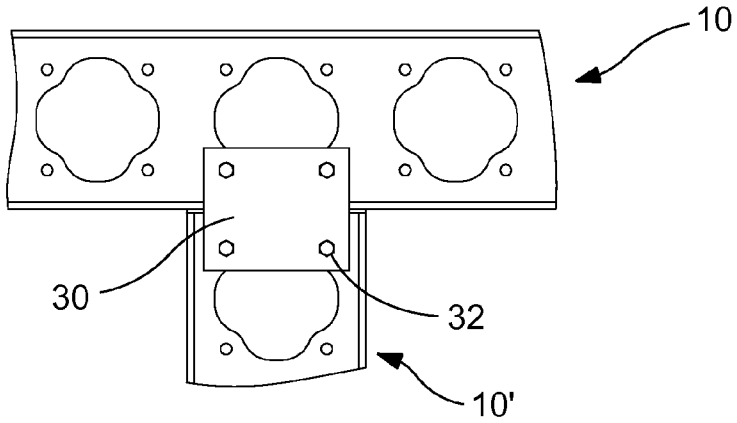
FIG. 11 is a top view of two adjacent tubular beams assembled to each other in a "T" configuration with a fastening plate in accordance with the present invention.
Figure 12:
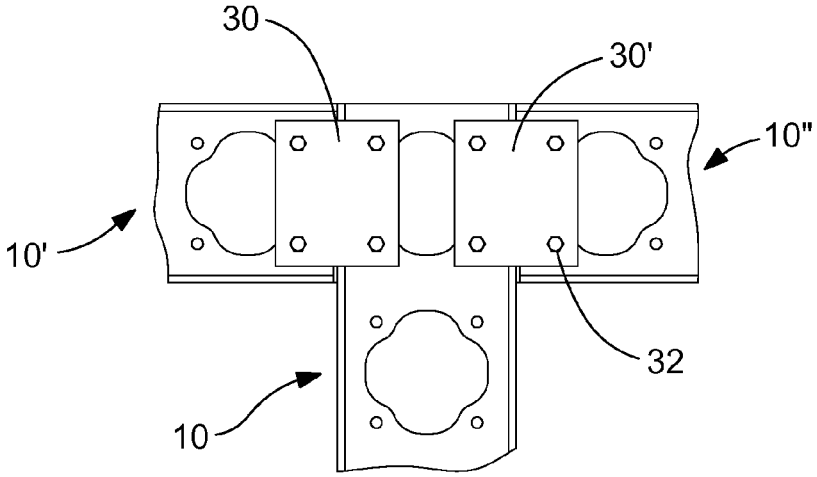
FIG. 12 is a top view of three adjacent tubular beams assembled to each other in a "T" configuration with two fastening plates in accordance with the present invention.

With reference to FIGS. 10-12, a fastening plate 30 includes four fastener holes 32 that are located to hold together two or more adjacent tubular beams in an "I," "L," "T" or "double T" configuration. The fastening plates 30 are used in addition to the previously mentioned fastening examples in FIGS. 4-9 for high stress joints.

With reference to FIG. 10, the tubular beam 10' is attached to the tubular beam 10 in an "I" configuration by inserting four threaded fasteners 26 through the plurality of fastener holes 32 in the fastening plate 30 and the plurality of fastener holes 22 in the tubular beams 10, 10'. Four nuts 28 are then threaded and tightened on to the four threaded fasteners 26. One fastening plate 30 is shown, but additional fastening plates 30 may be used.

With reference to FIG. 11, the tubular beam 10' is attached to the tubular beam 10 in a "T" configuration by inserting four threaded fasteners 26 through the plurality of fastener holes 32 in the fastening plate 30 and the plurality of fastener holes 22 in the tubular beams 10, 10'. Four nuts 28 are then threaded and tightened on to the four threaded fasteners 26. One fastening plate 30 is shown, but additional fastening plates 30 may be used.

With reference to FIG. 12, the tubular beams 10' and 10" are attached to the tubular beam 10 in a "T" configuration by inserting four threaded fasteners 26 through the plurality of fastener holes 32 in the fastening plate 30 and the plurality of fastener holes 22 in the tubular beams 10, 10', and inserting four threaded fasteners 26 through a second fastening plate 30' and the plurality of fastener holes 22 in the tubular beams 10, 10". Eight nuts 28 are then threaded and tightened on to the eight threaded fasteners 26. Two fastening plates 30, 30' are used, but additional fastening plates may be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A tubular beam for the construction of temporary structures, comprising:

a hollow rectangular tube having a first end, a second end and four substantially planar sides defining a cavity, each side having a first end and a second end defining the first and second ends of the beam, a plurality of tube access openings are formed through at least one of said four sides, a fastener hole pattern is formed around each one of said plurality of tube access openings, said fastener hole pattern includes a plurality of fastener holes; and a first end plate is attached to said first ends of said sides, a second end plate is attached to said second ends of said sides, a first end access opening is formed through said first end plate and adjacent and in communication with the tube cavity, and a second end access opening is formed through said second end plate and adjacent and in communication with the tube cavity, an end fastener hole pattern is formed around said first and second end access openings, said end fastener hole pattern includes a plurality of end fastener holes, said end fastener hole pattern is the same as said fastener hole pattern, wherein one of the ends of the tubular beam is attachable to a side of a second tubular beam having the fastener hole pattern and the end fastener hole pattern by securing fasteners to one of said plurality of fastener hole patterns and said end fastener hole pattern.

2. The tubular beam for the construction of temporary structures of claim 1, further comprising:

a plurality of threaded fasteners are inserted through said plurality of fastener holes to assemble at least two adjacent tubular beams, a plurality of nuts are threaded and tightened on said plurality of threaded fasteners to secure the at least two adjacent tubular beams.

3. The tubular beam for the construction of temporary structures of claim 1, further comprising:

a fastening plate having a plate hole pattern, said plate hole pattern is the same as said fastener hole pattern, said fastening plate being used to secure two adjacent tubular beams to each other.

4. The tubular beam for the construction of temporary structures of claim 1, further comprising:

a fastening plate having a plate hole pattern, said plate hole pattern is the same as said fastener hole pattern, said fastening plate being used to secure two adjacent tubular beams to each other.

5. A tubular beam for the construction of temporary structures, comprising:

a hollow rectangular tube having a first end, a second end and four substantially planar sides defining a cavity, each side having a first end and a second end defining the first and second ends of the beam, a plurality of tube access openings are formed through each one of said four sides, a fastener hole pattern is formed around each one of said plurality of tube access openings, said fastener hole pattern includes a plurality of fastener holes; and a first end plate is attached to said first ends of said sides and a second end plate is attached to said second ends of said sides, a first end access opening is formed through said first end plate and adjacent and in communication with the tube cavity, and a second end access opening is formed through said second end plate and adjacent and in communication with the tube cavity, an end fastener hole pattern is formed around said first and second end access openings, said end fastener hole pattern includes a plurality of end fastener holes, said end fastener hole pattern is the same as said fastener hole pattern, wherein one of the ends of the tubular beam is attachable to a side of a second tubular beam having the fastener hole pattern and end fastener hole pattern by securing fasteners to one of said plurality of fastener hole patterns and said end fastener hole pattern.

6. The tubular beam for the construction of temporary structures of claim 5, further comprising:

a plurality of threaded fasteners are inserted through said plurality of fastener holes to assemble at least two adjacent tubular beams, a plurality of nuts are threaded and tightened on said plurality of threaded fasteners to secure the at least two adjacent tubular beams.

7. The tubular beam for the construction of temporary structures of claim 5, further comprising:

a fastening plate having a plate hole pattern, said plate hole pattern is the same as said fastener hole pattern, said fastening plate being used to secure two adjacent tubular beams to each other.

8. A tubular beam for the construction of temporary structures, comprising:

a hollow rectangular tube having a first end, a second end and four substantially planar sides defining a cavity, each side having a first end and a second end defining the first and second ends of the beam, a plurality of tube access openings are formed through each one of said four sides, a fastener hole pattern is formed around each one of said plurality of tube access openings, said fastener hole pattern includes a plurality of fastener holes;

a first end plate is attached to said first ends of said sides, a second end plate is attached to said second end of said sides, a first end access opening is formed through said first ends plate and adjacent with and in communication with the tube cavity, and a second end access opening is formed through said second end plate and adjacent with and in communication with the tube cavity, an end fastener hole pattern is formed around said first and second end access openings, said end fastener hole pattern includes a plurality of end holes, said end fastener hole pattern is the same as said fastener hole pattern, wherein one of the ends of the tubular beam is attachable to a side of a second tubular beam having the fastener hole pattern and the end fastener hole pattern by securing fasteners to one of said plurality of fastener hole patterns and said end fastener hole pattern; and a distance between said plurality of fastener holes and one of said edges of said rectangular tube is equal to a distance between said plurality of end holes and one of said edges of said first and second plates.

9. The tubular beam for the construction of temporary structures of claim 8, further comprising:

a plurality of threaded fasteners are inserted through said plurality of fastener holes to assemble at least two adjacent tubular beams, a plurality of nuts are threaded and tightened on said plurality of threaded fasteners to secure the at least two adjacent tubular beams.

10. The tubular beam for the construction of temporary structures of claim 8, further comprising:

a fastening plate having a plate hole pattern, said plate hole pattern is the same as said fastener hole pattern, said fastening plate being used to secure two adjacent tubular beams to each other.

* * * * *